US007108218B2

(12) United States Patent
Chapman et al.

(10) Patent No.: US 7,108,218 B2
(45) Date of Patent: Sep. 19, 2006

(54) HOSE DISPENSER

(75) Inventors: Aaron Chapman, Newcastle upon Tyne (GB); David Graham Storey, Newcastle upon Tyne (GB); Paul Townsend, Newcastle upon Tyne (GB)

(73) Assignee: Draeger Safety UK Limited, Blyth (GB)

( * ) Notice: Subject to any disclaimer, the term of this patent is extended or adjusted under 35 U.S.C. 154(b) by 36 days.

(21) Appl. No.: 10/812,513

(22) Filed: Mar. 30, 2004

(65) Prior Publication Data

US 2004/0200921 A1 Oct. 14, 2004

(30) Foreign Application Priority Data

Apr. 1, 2003 (GB) ..... 0307557.9

(51) Int. Cl.
*B65H 59/04* (2006.01)

(52) U.S. Cl. ..... 242/421.8; 242/396.5; 242/422.4

(58) Field of Classification Search ..... 242/422, 242/422.4, 421.8, 421.9, 397, 397.1, 557, 242/396, 396.5, 396.6, 396.7, 396.8, 156
See application file for complete search history.

(56) References Cited

U.S. PATENT DOCUMENTS 2,039,915 A * 5/1936 McCoy ..... 242/396.5
2,215,121 A * 9/1940 Harvey et al.
2,262,462 A * 11/1941 Margis, Jr.
3,069,107 A * 12/1962 Hirt ..... 242/156
3,484,054 A 12/1969 Waywell et al. ..... 242/128
3,558,026 A * 1/1971 Rosen
3,602,452 A * 8/1971 Sauer ..... 242/421.8

(Continued)

FOREIGN PATENT DOCUMENTS

GB 286859 A 2/1927

(Continued)

*Primary Examiner*—William A. Rivera
(74) *Attorney, Agent, or Firm*—Bromberg & Sunstein LLP

(57) ABSTRACT

A hose dispenser has a rotatable reel 10, holding a coiled hose 12 suitable for conveying breathable gas, mounted on a tubular steel frame 14. The reel has a pivoting arm 16, which has a portion defining an aperture, or "eye" 18 fitted thereon. The hose is threaded through the eye 16 so that the free end of the hose protrudes through the eye. The free end of the hose is fitted with a resilient frusto-conical protective hood 20. The hood provides two functions. First, it enables the free end of the hose to engage the eye of the arm 16, and secondly, it protects a valve 22, located on the free end of the hose, from damage. Another valve 24 is provided in the centre of the reel, which is connected to the other end of the hose. In use, the free end of the hose is carried by an operative, or is attached to breathing apparatus worn by the operative, and the other end is connected to a source containing gas for breathing. The arm 16 is mounted pivotally on the reel. Due to the fact that the hose is threaded through the aperture portion mounted on the arm, when the hose is put under tension, i.e. when the end of the hose is pulled so as to uncoil the hose, the arm lifts. If the hose becomes slack, i.e. when it is not being pulled, the arm falls under gravity. The pivoting arm 16 is operatively connected to braking means which provides a brake for the reel 10 holding the hose. When the brake is engaged rotational motion of the reel is inhibited, thus preventing undesirably large amounts of hose from being dispensed from the reel 10 when the hose is slack.

18 Claims, 3 Drawing Sheets

U.S. PATENT DOCUMENTS 3,645,503 A * 2/1972 Doerfling ..... 242/397
4,228,553 A 10/1980 Genuit ..... 4/490
4,457,527 A * 7/1984 Lowery ..... 242/557
4,742,973 A * 5/1988 Stomski et al. ..... 242/156
6,637,694 B1 * 10/2003 Shibazaki et al. ..... 242/421.8
6,905,089 B1 * 6/2005 Solis et al. ..... 242/421.8

FOREIGN PATENT DOCUMENTS

GB 2 221 893 A 2/1990
JP 09110097 A 4/1997
JP 2004059302 A 2/2004

* cited by examiner

HOSE DISPENSER

The present invention relates to a hose dispenser, for dispensing hose. Such hose may be used, for example, for conveying fluid for breathing from a remote source to an operative, such as an inspection or cleaning operative working in an incident area or confined space.

Known hose dispensers typically include a reel, around which the hose is wound. The reel is often mounted on a trolley, to aid transportation of the dispenser. In use, one end of the hose wound around the drum is connected to a source of gas for breathing, and the other end is carried into an incident by an operative, connected to a harness worn by the operative. The operative would typically uncoil the desired amount of hose before entering an incident area. As the hose is transported away from the dispenser, the reel rotates allowing the hose to unwind from the reel as required by the operative moving away from the reel. Such a reel fitted with a hose has considerable inertia, so that when the operative stops pulling the hose, or slows down, the reel continues to turn, and the hose continues to uncoil. This can cause lengths of hose to fall onto the ground. Such a situation is potentially hazardous, particularly in the proximity of a firefighting incident. Furthermore, the freely uncoiling loose hose can jam the dispenser if the slack hose is not taken up. This may then cause problems if the operative wishes to draw more hose from the reel, and may in extreme cases cause the hose to become nipped, thus blocking the air supply conveyed through the hose, upon which the operative is dependent.

According to an aspect of the present invention there is provided a hose dispenser, for use with a hose for conveying fluid, the dispenser comprising:

a substantially cylindrical reel, for holding a length of hose, rotatably mounted on a support;

braking means for inhibiting rotation of the reel; and an arm, movable between first and second positions, being arranged to bear against a portion of hose in use, wherein the arm is operatively associated with the braking means such that when the arm is in the first position the braking means inhibits rotational motion of the reel, and when the arm is in the second position the braking means does not inhibit rotational motion of the reel, and the reel is able to rotate to dispense hose.

Preferably the support comprises a frame.

Preferably the arm is arranged in use to be moveable between the first and second positions in dependence upon tension in a hose bearing against the arm.

In a preferred arrangement the arm is pivotally mounted, at at least one end thereof, on the reel. Pivotal movement of the arm between the first and second positions may be arranged to cause engagement and disengagement of the braking means.

The arm may comprise a guide portion arranged in use to guide a hose for dispensing from the reel. The guide portion may comprise a channel or tube through which a hose is arranged in use to pass.

The braking means may comprise a brake member, such as a brake pad, and a drum against which the brake member is arranged to bear when the braking means is engaged.

The guide portion may be arranged in use to co-operate with an end portion of the hose when the hose is substantially fully coiled on the reel. The end portion of the hose may lockably engage the guide portion. The end portion of the hose may comprise a substantially frusto-conical hood, which may also serve to protect the exposed end of the hose.

The hose dispenser may be mounted on a trolley.

According to another aspect of the present invention there is provided a hose dispensing apparatus, comprising a reel, holding a length of hose for conveying fluid, the hose having a free end; and braking means for inhibiting rotational motion of the reel, wherein the braking means engages to inhibit rotational motion of the reel except when a tension force is applied to the free end of the hose.

In a preferred arrangement, application of a tension force to the free end of the hose causes an arm, mounted on the reel and operatively associated with the braking means, to move into a first position, in which the brake is disengaged. In the absence of such application the hose causes the arm to move into a second position in which the brake is engaged.

Preferred embodiments of the present invention will now be described, by way of example only, with reference to the accompanying drawings, in which.

Figure 1:
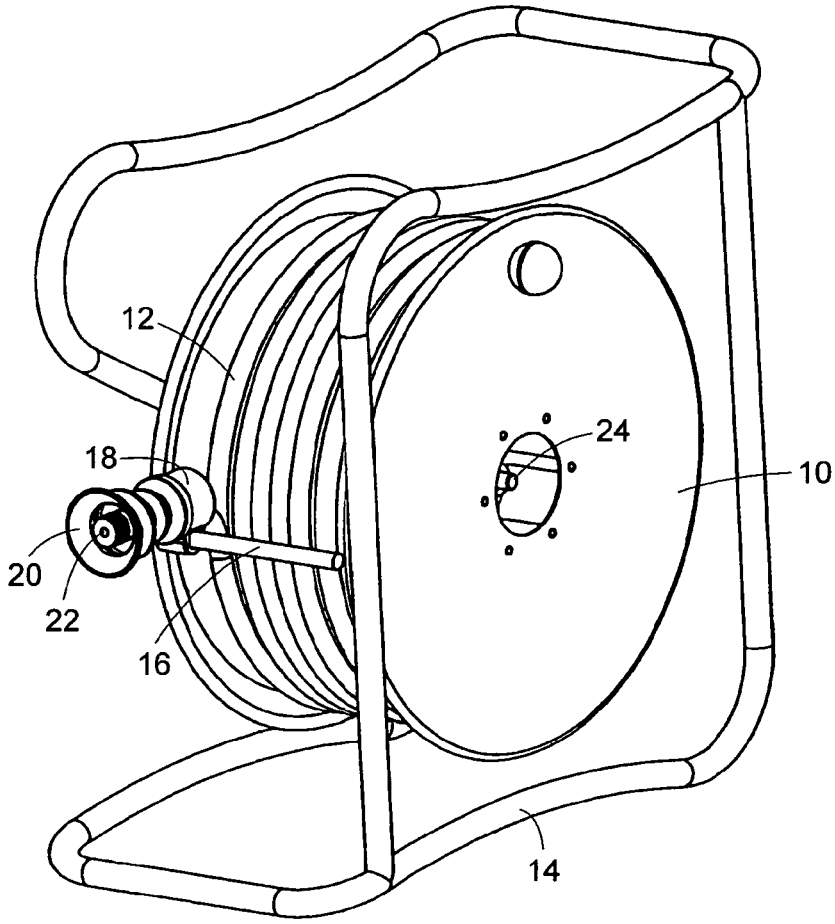
FIG. 1 is a perspective view of a first embodiment of hose dispenser.

Turning to FIG. 1, this shows generally at 10 a rotatable reel 10, holding a coiled hose 12 suitable for conveying breathable gas, mounted on a tubular steel frame 14. The reel has a pivoting arm 16, which has a portion defining an aperture, or "eye" 18 fitted thereon. The hose is threaded through the eye 16 so that the free end of the hose protrudes through the eye. The free end of the hose is fitted with a resilient frusto-conical protective hood 20. The hood provides two functions. First, it enables the free end of the hose to engage the eye of the arm 16, and secondly, it protects a valve 22, located on the free end of the hose, from damage. Another valve 24 is provided in the centre of the reel, which is connected to the other end of the hose. In use, the free end of the hose is carried by an operative, or is attached to breathing apparatus worn by the operative, and the other end is connected to a source containing gas for breathing.

Figure 2:
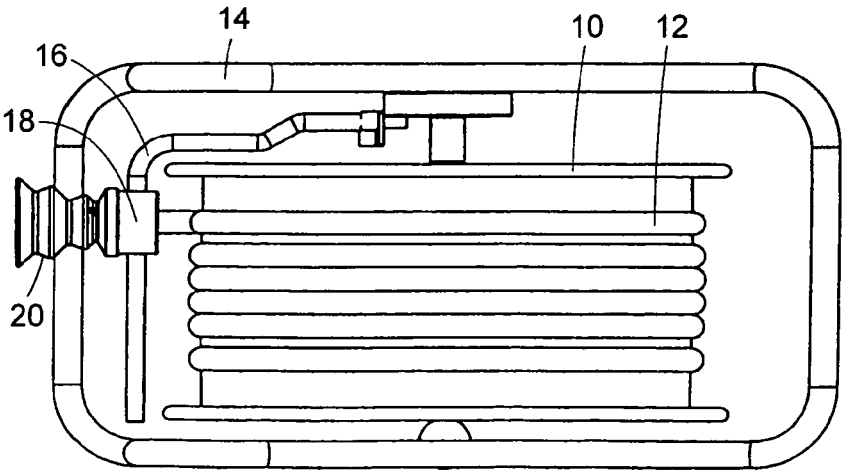
FIG. 2 is a plan view of the dispenser of FIG. 1.

FIG. 2 is a plan view of the reel of FIG. 1. The arm 16 is mounted pivotally on the reel. Due to the fact that the hose is threaded through the aperture portion mounted on the arm, when the hose is put under tension, i.e. when the end of the hose is pulled so as to uncoil the hose, the arm lifts. If the hose becomes slack, i.e. when it is not being pulled, the arm falls under gravity.

Figure 3:
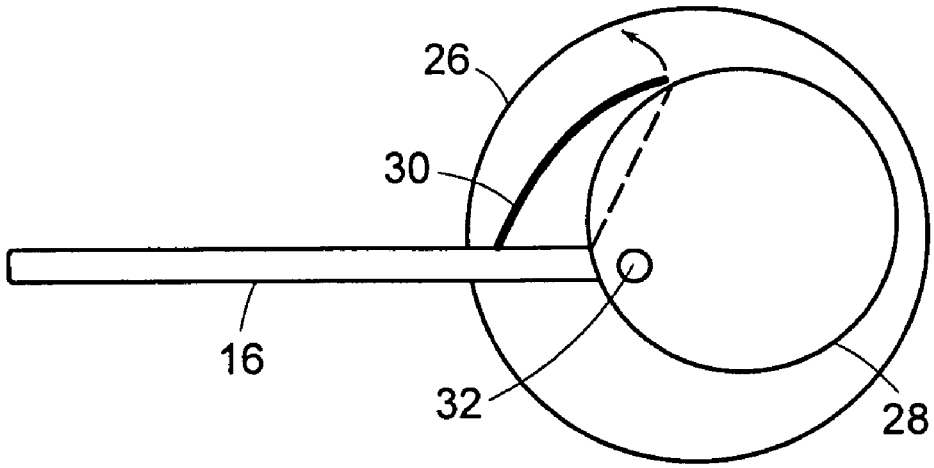
FIG. 3 is a schematic view of a braking system of the dispenser of FIGS. 1 and 2 in its disengaged position.
Figure 4:
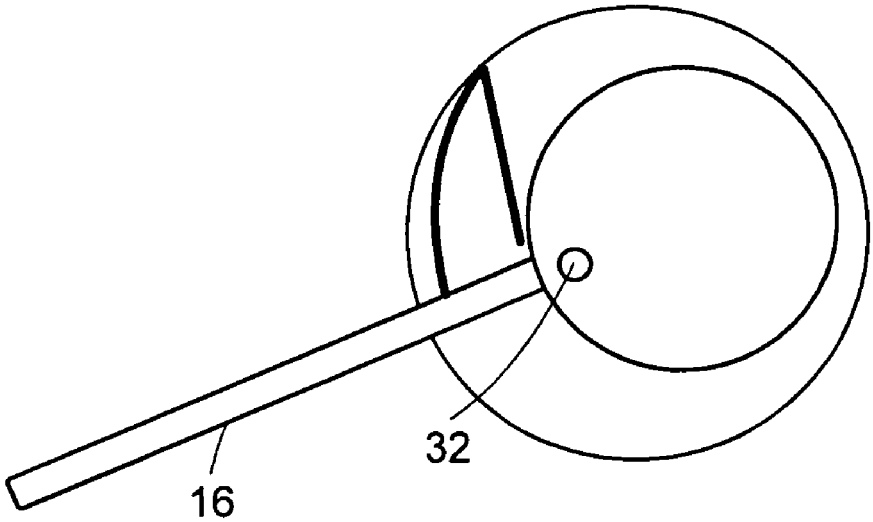
FIG. 4 shows schematically the braking system of FIG. 3 in its engaged position.

The pivoting arm 16 is operatively connected to braking means, as can be seen from schematic FIGS. 3 and 4. The braking means provides a brake for the reel 10 holding the hose and comprises a brake drum 26, a fixed, i.e. non-rotatable, reel-carrier 28, and a brake shoe 30. The arm 16 is connected to the brake shoe 30 and is pivotally mounted on the fixed reel-carrier 28 at a pivot point 32. When the arm is lifted, by putting the hose under tension, the brake shoe clears, and therefore does not engage, the brake drum 26, and the reel 10 holding the hose can rotate freely to dispense hose. However, when the hose is no longer under tension, the arm 16 falls, as described above. This case is shown schematically in FIG. 4. Due to the pivotal mounting of the arm 16, when the arm drops, the brake shoe 30 or a brake pad retained therein (not shown) makes contact with the inside surface of the brake drum 26. When the brake is engaged rotational motion of the reel is inhibited, thus preventing undesirably large amounts of hose from being dispensed from the reel 10 when the hose is slack.

Figure 6:
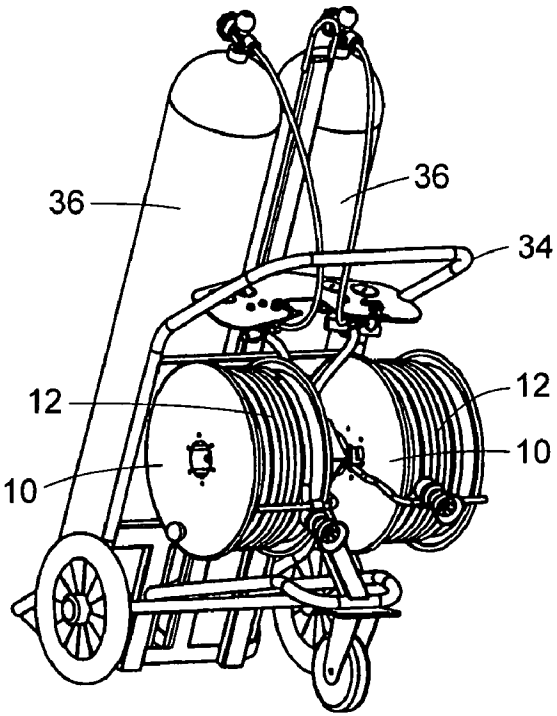
FIG. 6 shows another embodiment of dispenser in which two reels are mounted on a trolley.
Figure 5:
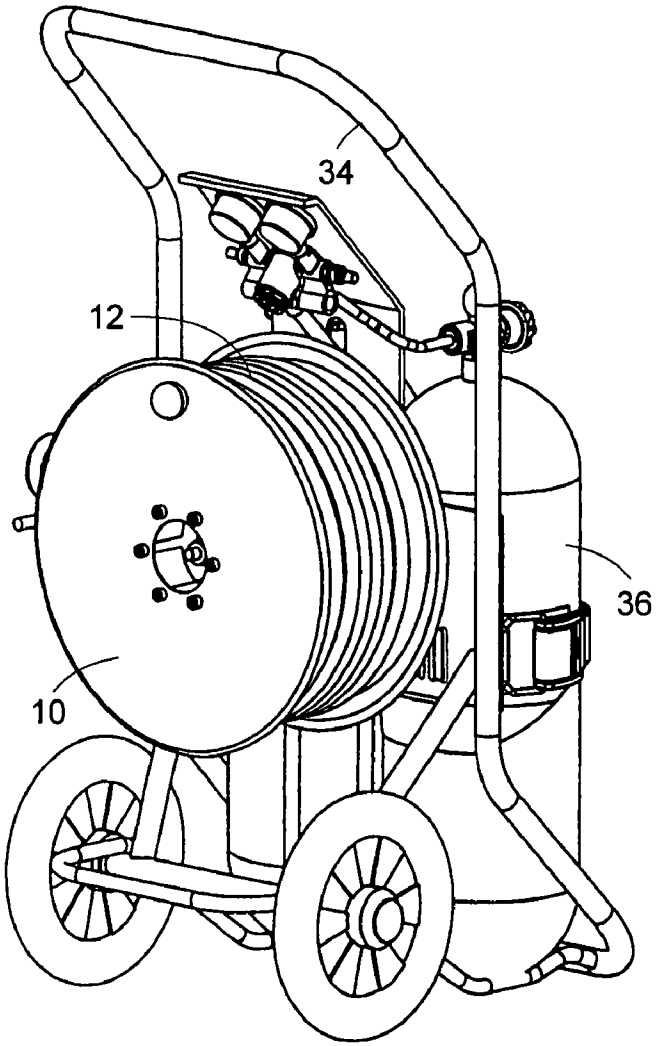
FIG. 5 shows another embodiment of dispenser in which a reel is mounted on a trolley.

FIGS. 5 and 6 show hose dispensers 10 of the kind described as above mounted on trolleys 34 in different configurations and connected to cylinders 36 of different sizes containing fluid for breathing. The trolley of FIG. 5 might for example be used by a single operative on the hose, whereas the trolley shown in FIG. 6, having two reels and two hoses could support two operatives. Typically the trolley would remain in a safe location or base-station, and the operative would attach the hose 12 to a harness, connected by a further hose to a face mask. A system such as this obviates the need for an operative to carry a heavy and cumbersome cylinder on his back. The operative is able to enter an incident or confined space, breathing the fluid conveyed through the hose 12 from the cylinder(s) 36. As the operative moves away from the trolley the hose 12 is progressively dispensed from the reel 10, since the hose is under tension and the brake thus disengaged. When sufficient hose is dispensed or the operative stops moving, the hose slackens and the brake (see discussion of FIG. 4 above) is applied. This stops the motion of the reel 10 and therefore prevents further hose 12 from being uncoiled from the reel 10.

When the hose is fully re-coiled onto the reel for example by turning a winding handle (not shown), the hood 20 eventually engages the eye 18 to hold the arm 16 in the lowered position and thereby effectively to lock the reel.

In one mode of use, the operative may still carry a lightweight or short-duration cylinder (not shown), either as a back-up or else for use whilst the operative travels to the workplace, whereupon he or she then connects to the hose 12 to obtain breathing fluid from the cylinder 36.

The invention claimed is:

1. A hose dispenser, for use with a hose for conveying fluid, the dispenser comprising:

a substantially cylindrical reel, for holding a length of hose, the hose being rotatably mounted on a support;

braking means for inhibiting rotation of the reel; and an arm, movable between first and second positions, being arranged to bear against a portion of hose in use, wherein the arm is operably associated with the braking means such that when the arm is in the first position the braking means inhibits rotation al motion of the reel, and when the arm is in the second position the braking means does not inhibit rotational motion of the reel, and the reel is able to rotate to dispense hose, wherein the braking means comprises a brake drum having an inside surface and a brake shoe, and wherein the braking means engages the inside surface of the brake drum to inhibit rotational motion of the reel except when a tension force is applied to the hose.

2. A hose dispenser according to claim 1, wherein the support comprises a frame.

3. A hose dispenser according to claim 1, wherein the arm is arranged in use to be moveable between the first and second positions in dependence upon tension in a hose bearing against the arm.

4. A hose dispenser according to claim 1, wherein the arm is pivotally mounted, at least one end thereof, with respect to the reel.

5. A hose dispenser according to claim 4, wherein pivotal movement of the arm between the first and second positions is arranged to cause engagement or disengagement of the braking means.

6. A hose dispenser according to claim 1, wherein the arm comprises a guide portion arranged in use to guide a hose when dispensing from the reel.

7. A hose dispenser according to claim 6, wherein the guide portion comprises a channel or tube through which a hose is arranged in use to pass.

8. A hose dispenser according to claim 6, wherein the guide portion is arranged in use to co-operate with an end portion of a hose when a hose is substantially full coiled on the reel.

9. A hose dispenser according to claim 8, wherein the guide portion is arranged in use to engage lockably the end portion of the hose.

10. A hose dispenser according to claim 1, including a hose, the end portion of said hose comprising a substantially frusto-conical hood, which serves to protect the exposed said end of the hose.

11. A hose dispenser according to claim 1, wherein the hose dispenser according to claim 1, wherein the hose dispenser is mounted on a trolley.

12. A hose dispenser according to claim 1, wherein the arm has a pivot point inside the brake drum.

13. A hose dispenser according to claim 1, wherein a free end of the hose is fitted with a protective hood.

14. A hose dispensing apparatus, comprising a reel, holding a length of hose for conveying fluid, the hose having a free end; and braking means for inhibiting rotational motion of the reel, wherein the braking means comprises a brake drum having an inside surface and a brake shoe, and wherein the braking means engages the inside surface of the brake drum to inhibit rotational motion of the reel except when a tension force is applied to the hose.

15. A hose dispending apparatus according to claim 14, wherein the apparatus is arranged such that application of a tension force to the hose causes an arm, mounted on the reel and operatively associated with the braking means, to move into a first position, in which the brake is disengaged, and such that in the absence of application of such a tension force the hose causes the arm to move into a second position in which the brake is engaged.

16. A hose dispending apparatus according to claim 14, wherein the arm has a pivot point inside the brake drum.

17. A hose dispensing apparatus according to claim 14, wherein the free end of the hose is fitted with a protective hood.

18. A hose dispensing apparatus according to claim 17, wherein the protective hood is a frusto-conical protective hood.

* * * * *